US012442610B2

(12) United States Patent
Naumu

(10) Patent No.: US 12,442,610 B2
(45) Date of Patent: Oct. 14, 2025

(54) FIREARM SUPPRESSOR ASSEMBLY

(71) Applicant: Vincent Naumu, Gillette, WY (US)

(72) Inventor: Vincent Naumu, Gillette, WY (US)

( * ) Notice: Subject to any disclaimer, the term of this patent is extended or adjusted under 35 U.S.C. 154(b) by 30 days.

(21) Appl. No.: 18/423,999

(22) Filed: Jan. 26, 2024

(65) Prior Publication Data

US 2025/0244095 A1 Jul. 31, 2025

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4
See application file for complete search history.

(56) References Cited

U.S. PATENT DOCUMENTS

| | | | | |
|---|---|---|---|---|
| 8,453,789 | B1 * | 6/2013 | Honigmann | F41A 21/325 89/14.4 |
| 9,347,727 | B1 * | 5/2016 | Cler | F41A 21/30 |
| D767,706 | S | 9/2016 | Shults | |
| 10,330,419 | B1 * | 6/2019 | Holderby | F41A 21/30 |
| 10,794,651 | B2 | 10/2020 | Crown | |
| 11,353,277 | B2 | 6/2022 | Muceus | |
| 11,561,059 | B2 | 1/2023 | Reis-Green | |
| 11,585,623 | B2 | 2/2023 | Borunsky | |
| 11,609,058 | B2 | 3/2023 | Petersen | |
| 11,668,541 | B2 | 6/2023 | Grob | |
| 2012/0145478 | A1 * | 6/2012 | Brittingham | F41A 21/30 181/264 |
| 2016/0018179 | A1 * | 1/2016 | Morris | F41A 21/30 181/223 |
| 2017/0191779 | A1 * | 7/2017 | Myers | F41A 21/48 |
| 2018/0128566 | A1 * | 5/2018 | Reis Green | F41A 21/30 |
| 2022/0163281 | A1 * | 5/2022 | Madigan | F41A 21/30 |
| 2023/0128489 | A1 | 4/2023 | Lo | |
| 2023/0417507 | A1 * | 12/2023 | Kras | F41A 21/34 |

FOREIGN PATENT DOCUMENTS

| | | |
|---|---|---|
| WO | WO2022147454 | 7/2022 |

* cited by examiner

*Primary Examiner* — Samir Abdosh

(57) ABSTRACT

A firearm suppressor assembly includes a modular suppressor which comprises a tube and a pair of end caps each being attachable to opposing ends of the tube and a plurality of baffles each being positionable within the tube such that a first bullet hole in each of the pair of end caps is aligned with a second bullet hole in each of the plurality of baffles. A bullet from a firearm passes through the first bullet hole in the end caps and the second bullet hole in each of the plurality of baffles when the modular suppressor is attached to a firearm. Each of the plurality of baffles has a plurality of gas holes is in fluid communication with a vent hole in the tube to pass combustion gases through the gas holes and the vent hole thereby reducing the intensity of the report of the firearm.

11 Claims, 6 Drawing Sheets

FIREARM SUPPRESSOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to suppressor devices and more particularly pertains to a new suppressor device for suppressing the report of a firearm. The device includes a tube and a plurality of baffles that are insertable into the tube. Each of the baffles includes a disk and a cone and each of the baffles has a plurality of gas holes for passing combustion gasses through the baffles and outwardly through a vent hole in the tube. The device includes a pair of end caps that are attachable to opposite ends of the tube for securing the plurality of baffles in the tube.

(2) Description of Related Art Including Information Disclosed Under 37 CFR 1.97 and 1.98

The prior art relates to suppressor devices including a variety of firearm suppressors that are each unitary structures that can be attached to a firearm for suppressing the report of the firearm and a variety of suppressor baffle devices that are employed in a suppressor for suppressing the report of a firearm and a modular suppressor device that includes conical baffles and parabolic surfaces and a pair of strategically structured screens. In no instance does the prior art disclose a modular firearm suppressor that can be fully disassembled by a user without the use of specialized tools which employs a plurality of conical baffles.

BRIEF SUMMARY OF THE INVENTION

An embodiment of the disclosure meets the needs presented above by generally comprising a modular suppressor which comprises a tube and a pair of end caps each being attachable to opposing ends of the tube and a plurality of baffles each being positionable within the tube such that a first bullet hole in each of the pair of end caps is aligned with a second bullet hole in each of the plurality of baffles. A bullet from a firearm passes through the first bullet hole in the end caps and the second bullet hole in each of the plurality of baffles when the modular suppressor is attached to a firearm. Each of the plurality of baffles has a plurality of gas holes is in fluid communication with a vent hole in the tube to pass combustion gases through the gas holes and the vent hole thereby reducing the intensity of the report of the firearm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
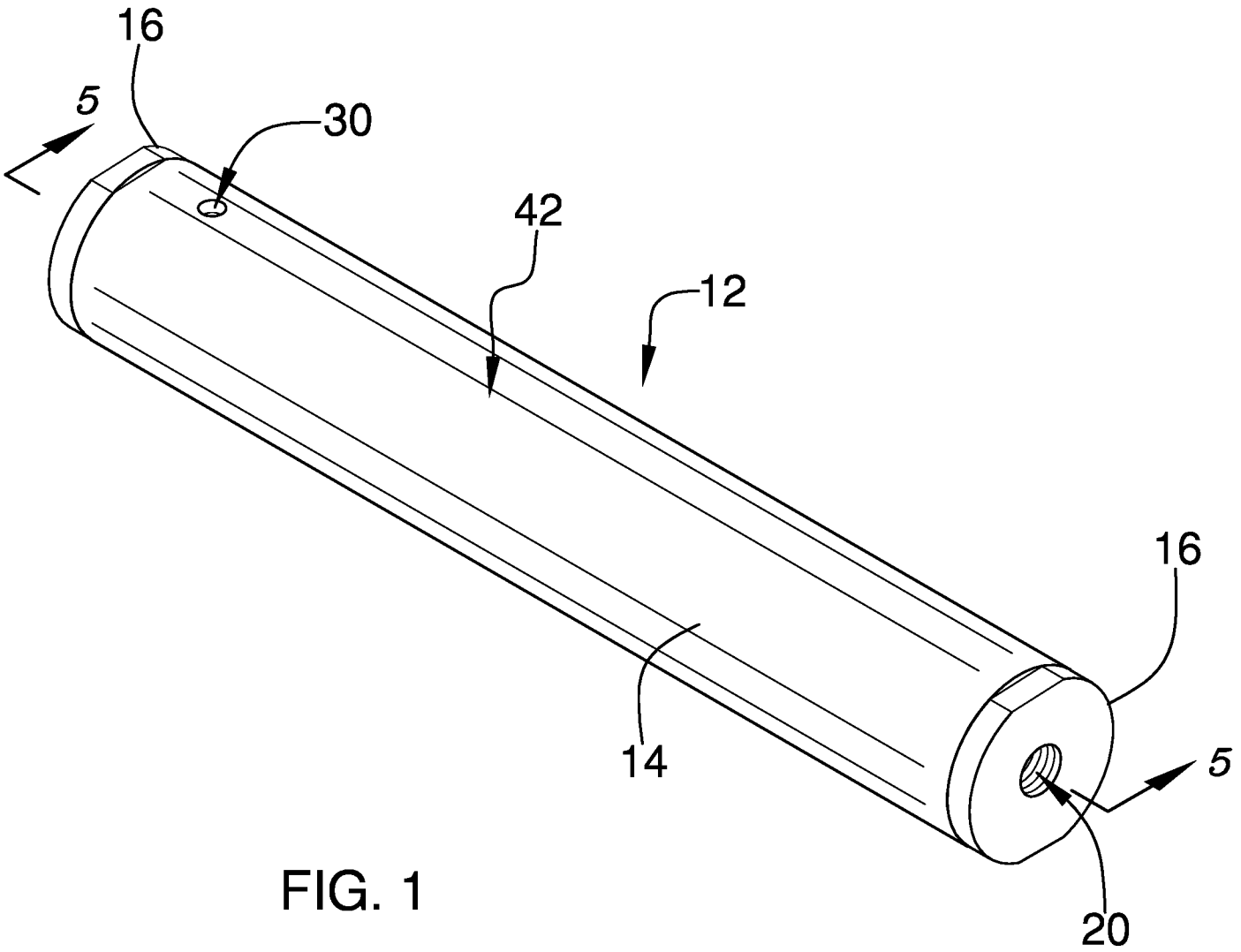
FIG. 1 is a perspective view of an embodiment of the disclosure.
Figure 2:
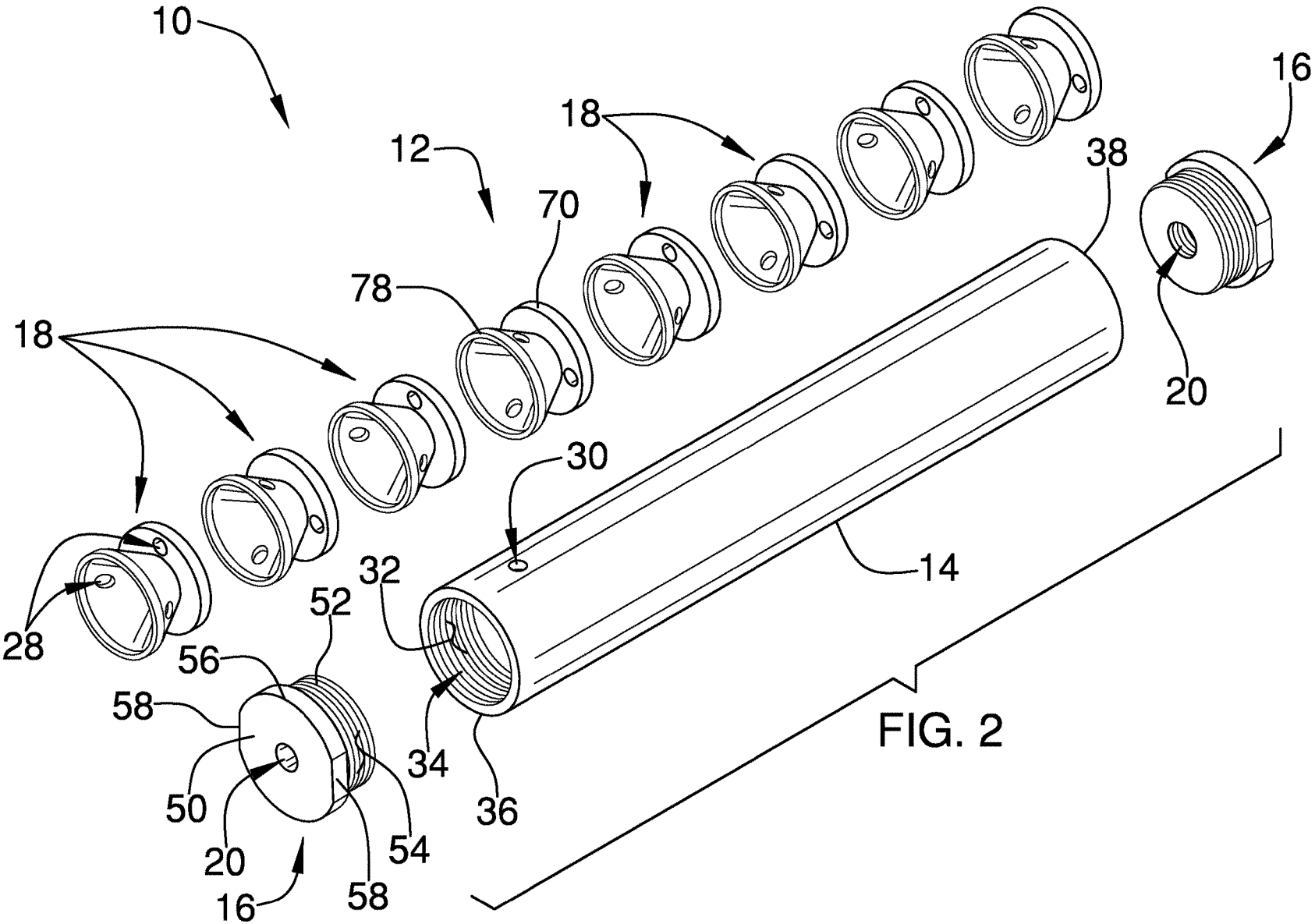
FIG. 2 is an exploded perspective view of a firearm suppressor assembly according to an embodiment of the disclosure.
Figure 4:
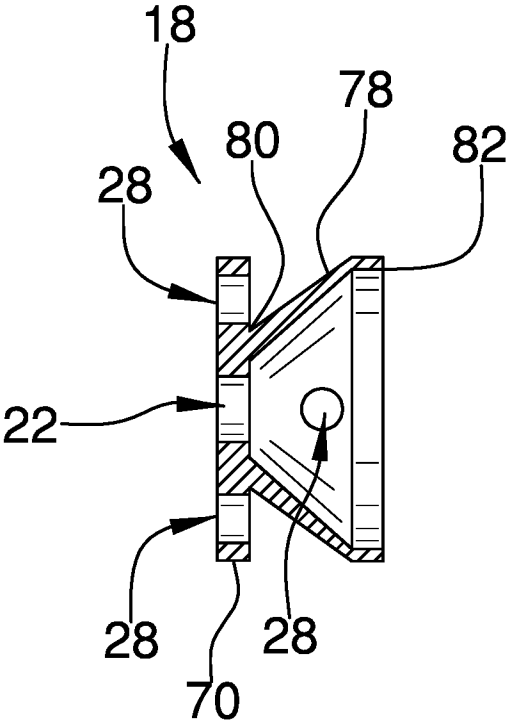
FIG. 4 is a cross sectional view taken along line 4-4 of FIG. 3 of an embodiment of the disclosure.
Figure 3:
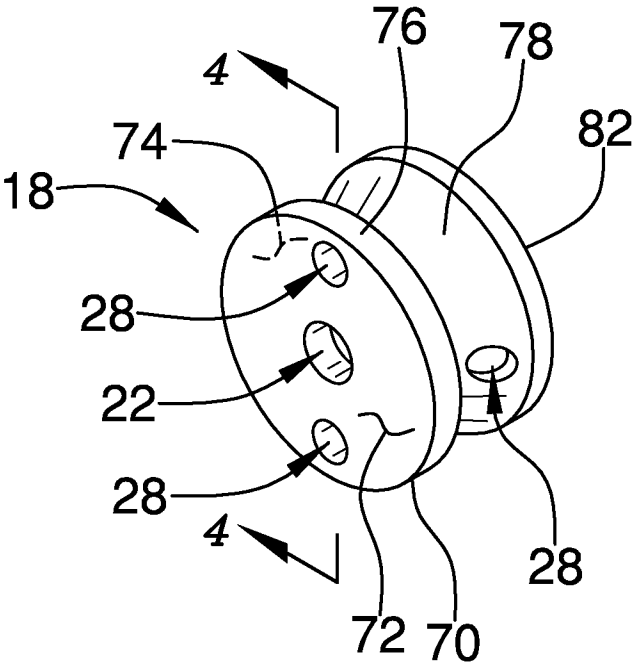
FIG. 3 is a back perspective view of a baffle of an embodiment of the disclosure.
Figure 5:
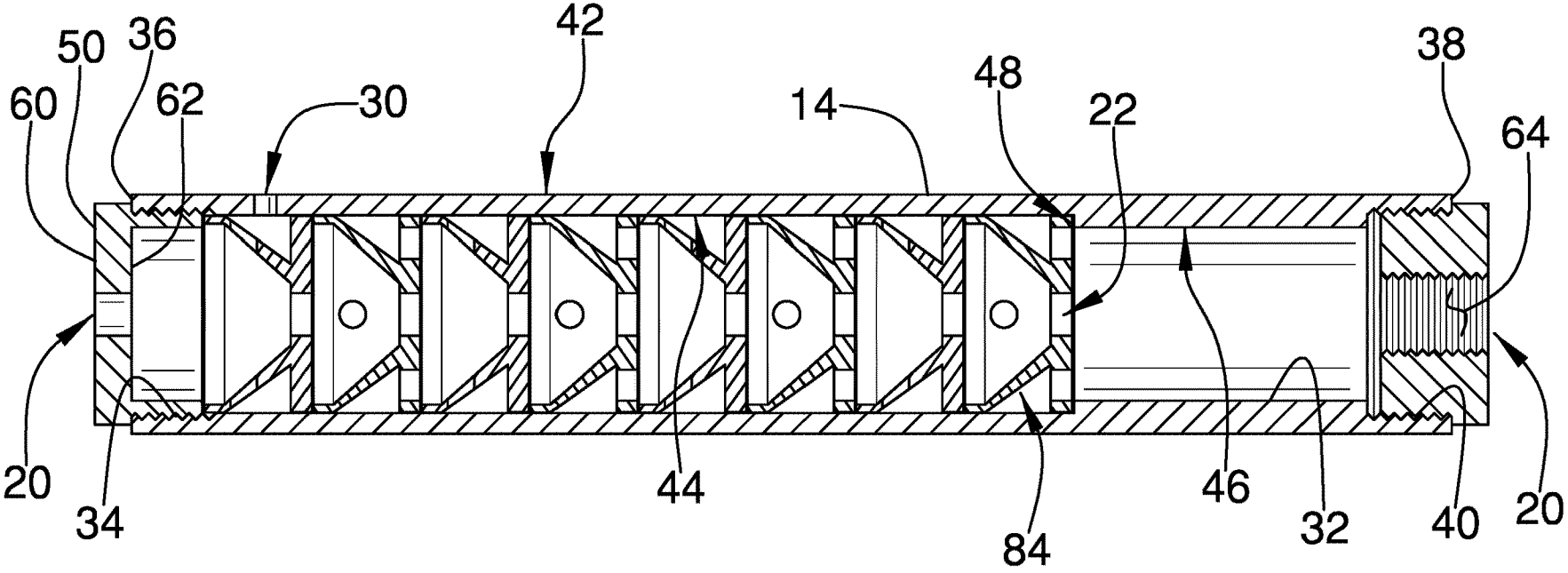
FIG. 5 is a cross sectional view taken along line 5-5 of FIG. 1 of an embodiment of the disclosure.
Figure 6:
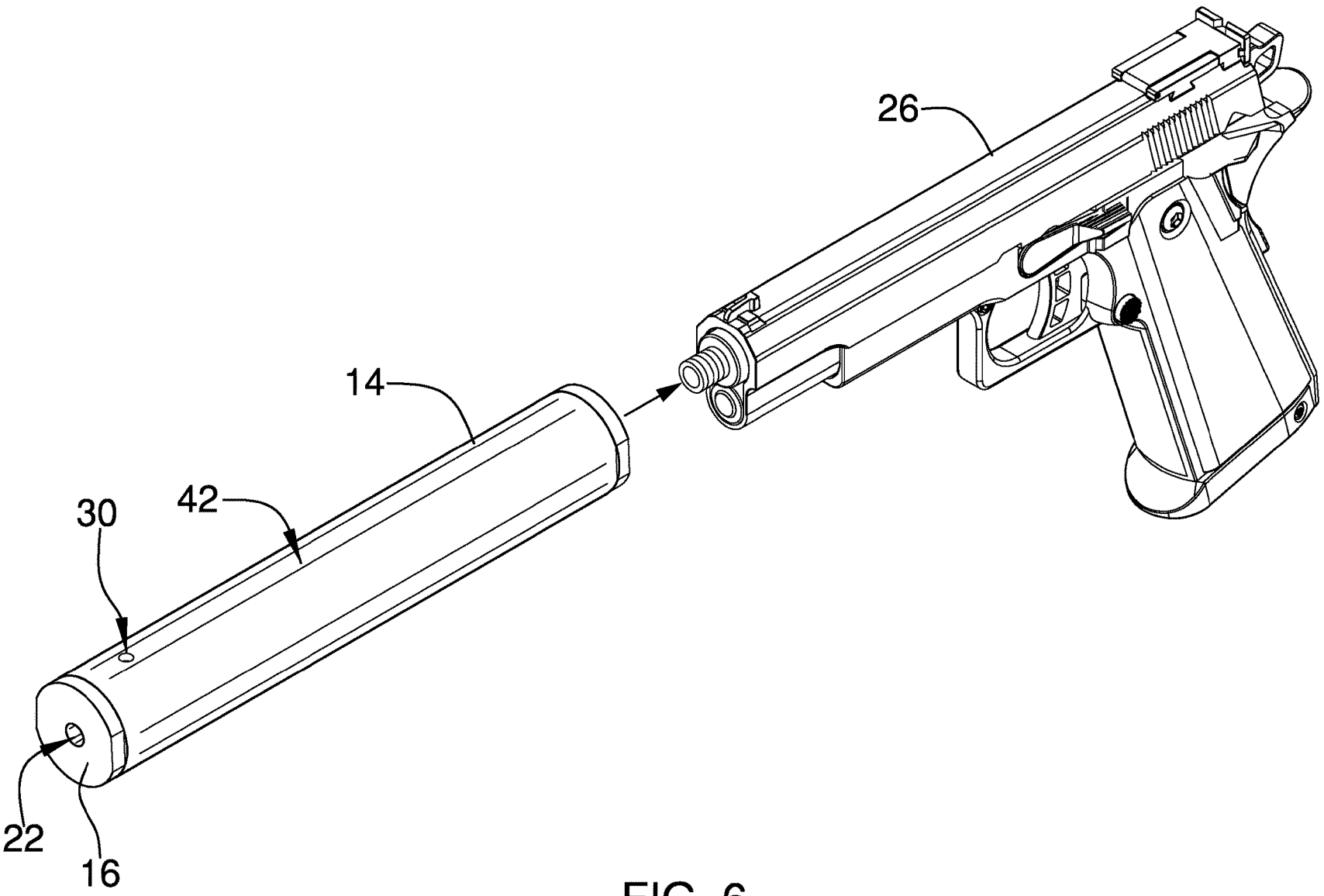
FIG. 6 is an exploded perspective view of an embodiment of the disclosure.
Figure 7:
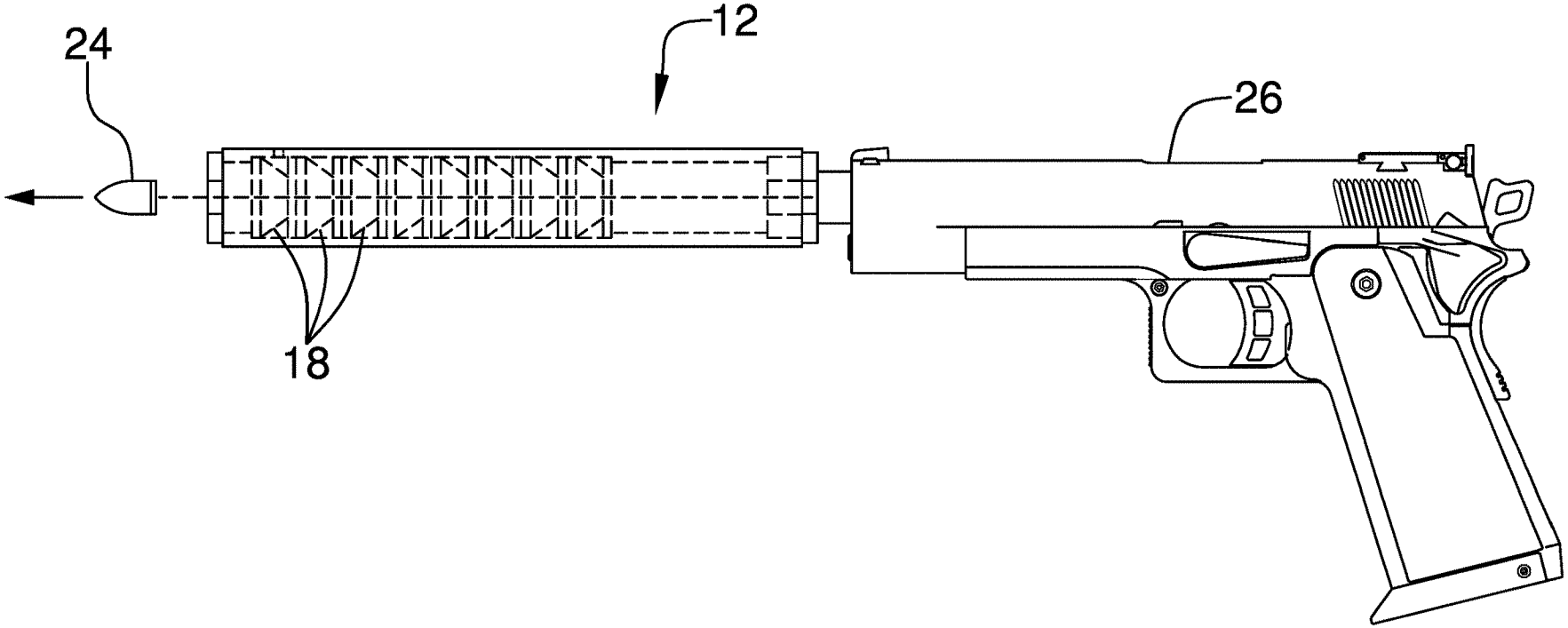
FIG. 7 is a phantom in-use view of an embodiment of the disclosure.

With reference now to the drawings, and in particular to FIGS. 1 through 7 thereof, a new suppressor device embodying the principles and concepts of an embodiment of the disclosure and generally designated by the reference numeral 10 will be described.

As best illustrated in FIGS. 1 through 7, the firearm suppressor assembly 10 generally comprises a modular suppressor 12 comprising a tube 14 and a pair of end caps 16 each being attachable to opposing ends of the tube 14. The modular suppressor 12 includes a plurality of baffles 18 each being positionable within the tube 14 such that a first bullet hole 20 in each of the pair of end caps 16 is aligned with a second bullet hole 22 in each of the plurality of baffles 18. In this way the modular suppressor 12 can pass a bullet 24 from a firearm 26 through the first bullet hole 20 in the end caps 16 and the second bullet hole 22 in each of the plurality of baffles 18 when the modular suppressor 12 is attached to a firearm 26. The firearm 26 may be a handgun which has a threaded barrel or other type of firearm that is capable of being equipped with a suppressor of any conventional design.

Each of the plurality of baffles 18 has a plurality of gas holes 28 which are in fluid communication with a vent hole 30 in the tube 14. Furthermore, the plurality of baffles 18 can pass combustion gases produced from the combustion of gunpower through the gas holes 28 and the vent hole 30. In this way baffles 18 and the vent hole 30 reduce intensity of the report of the firearm 26. Furthermore, the structure of the modular suppressor 12 conforms to the laws of the State of Wyoming thereby permitting the modular suppressor 12 to be legally purchased and employed in the State of Wyoming as well as several other of states in the United States of America.

The tube 14 has an inside surface 32 which has a first threaded portion 34 extending from a first end 36 of the tube 14 toward a second end 38 of the tube 14. Additionally, the inside surface 32 of the tube 14 has a second threaded portion 40 which extends from the second end 38 toward the first end 36. The vent hole 30 extends through an outer wall 42 of the tube 14 at a point located closer to the first end 36 than the second end 38. The inside surface 32 of the tube 14 has a first section 44 which has a diameter that is greater than a diameter of a second section 46 of the inside surface 32. The first section 44 is associated with the first end 36 and the second section 46 is associated with the second end 38. Additionally, a threshold 48 between the first section 44 and the second section 46 is located closer to the second end 38 of the tube 14 than the first end 36.

Each of the pair of end caps 16 has a head 50 and a stem 52 and an outside surface 54 of the stem 52 of each of the pair of end caps 16 is threaded. In this way the outside surface 54 of the stem 52 of each of the pair of end caps 16 can threadably engage a respective one of the first threaded portion 34 and the second threaded portion 40 of the inside surface 32 of the tube 14 such that the head 50 of each of the pair of end caps 16 abuts a respective one of the first end 36 and the second end 38 of the tube 14. The head 50 of each of the pair of end caps 16 has an outer edge 56 and the outer edge 56 of each of head 50 has a pair of flattened portions 58 being positioned on opposing sides of the head 50 from each other. The first bullet hole 20 extends through a front surface 60 of the head 50 and a back surface 62 of the stem 52 and the first bullet hole 20 is centrally located. A bounding surface 64 of the first bullet hole 20 in a first one of the pair of end caps 66 is threaded thereby facilitating the bounding surface 64 of the first bullet hole 20 in the first end 36 cap to threadably engage a barrel 68 of the firearm 26.

Each of the plurality baffles 18 comprises a disk 70 that has a first surface 72 and a second surface 74. The second bullet hole 22 extends through the first surface 72 and second surface 74 and the second bullet hole 22 is centrally located on the disk 70. A respective pair of the gas holes 28 extends through the first surface 72 and the second surface 74 and each of the respective gas holes 28 is positioned between the second bullet hole 22 and a perimeter edge 76 of the disk 70. The pair of respective gas holes 28 are aligned with each other. Additionally, each of the pair of respective gas holes 28 has a diameter that is less than a diameter of the second bullet hole 22.

Each of the plurality of baffles 18 includes a cone 78 that has a coupled end 80 and a free end 82. The cone 78 flares outwardly between the coupled end 80 and the free end 82 and each of the coupled end 80 and the free end 82 is open. The coupled end 80 is coupled to the second surface 74 of the disk 70 having the coupled end 80 surrounding the second bullet hole 22. Respective ones of the plurality of gas holes 28 extends through the cone 78 at point that is centrally located between the coupled end 80 and the free end 82. Additionally, the gas holes 28 in the cone 78 are positioned on opposite sides of the cone 78 from each other.

The baffles 18 are positioned in the tube 14 such that the free end 82 of the cone 78 of each of the plurality of baffles 18 abuts the first surface 72 of the disk 70 of an adjacent one of the plurality of baffles 18. The first surface 72 of the disk 70 of a rearmost one of the plurality of baffles 84 in the tube 14 abuts the threshold 48 between the first section 44 of the inside surface 32 of the tube 14 and the second section 46 of the inside surface 32 of the tube 14. Additionally, the plurality of baffles 18 extends between the second section 46 of the inside surface 32 of the tube 14 and the first threaded portion 34 of the inside surface 32 of the tube 14 when the plurality of baffles 18 is positioned in the tube 14. The baffles 18 are arranged such that the each of the baffles 18 is offset ninety degrees of rotation about an axis extending between the first end 36 and the second end 38 of the tube 14 with respect to an adjacent one of the plurality of baffles 18 when the plurality of baffles 18 is positioned in the tube 14. Thus, none of the plurality of gas holes 28 in a respective one of the plurality of baffles 18 is aligned with any of the plurality of gas holes 28 in an adjacent one of the plurality of baffles 18. In this way the plurality of gas holes 28 in the plurality of baffles 18 inhibits the combustion gas from having a direct path through the tube 14 thereby reducing the energy of the combustion gas as it passes through each of the plurality of baffles 18 before the combustion gas exits the vent hole 30 in the tube 14.

In use, each of the plurality of baffles 18 is inserted into the first end 36 of the tube 14 such that the disk 70 of each baffle is directed toward the second end 38 of the tube 14. Additionally, each of baffles 18 is offset ninety degrees of rotation with an adjacent baffle 18 to ensure that none of the gas holes 28 in the baffles 18 are aligned with the gas holes 28 in another baffle 18. Each of the first end 36 cap and the second end 38 cap are attached to the tube 14 once all of the baffles 18 have been placed in the tube 14. The barrel 68 of the firearm 26 is threaded into the first bullet hole 20 in the first end 36 cap to attach the modular suppressor 12 to the firearm 26. The combustion gasses produced each time the firearm 26 is discharged travels a winding course through the modular suppressor 12 as the combustion gases pass through each of the plurality of gas holes 28 in the baffles 18 and ultimately exits the tube 14 through the vent hole 30 while the bullet 24 passes directly through the first bullet hole 20 in each of the end caps 16 and the second bullet hole 22 in each of the baffles 18. In this way the intensity of the report of the firearm 26 is reduced each time the firearm 26 is discharged. Furthermore, the modular suppressor 12 can be disassembled or assembled in the field without the use of specialized tools thereby facilitating the modular suppressor 12 to be serviced, if necessary, in a remote location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A firearm suppressor assembly for reducing the intensity of the report of a firearm, said assembly comprising:

a modular suppressor comprising a tube and a pair of end caps each being attachable to opposing ends of said tube and a plurality of baffles each being positionable within said tube such that a first bullet hole in each of said pair of end caps is aligned with a second bullet hole in each of said plurality of baffles wherein said modular suppressor is configured to pass a bullet from a firearm through said first bullet hole in said end caps and said second bullet hole in each of said plurality of baffles when said modular suppressor is attached to a firearm, each of said plurality of baffles having a plurality of gas holes being in fluid communication with a vent hole in said tube wherein said plurality of baffles is configured to pass combustion gases produced from the combustion of gunpower through said gas holes and said vent hole thereby reducing the intensity of the report of the firearm; and wherein said plurality of baffles is arranged such that said each of said plurality of baffles is offset ninety degrees of rotation about an axis extending through a first end and a second end of said tube with respect to an adjacent one of said plurality of baffles when said plurality of baffles is positioned in said tube such that none of said plurality of gas holes in a respective one of said plurality of baffles is aligned with any of said plurality of gas holes in an adjacent one of said plurality of baffles wherein said plurality of gas holes in said plurality of baffles is configured to inhibit the combustion gas from having a direct path through said tube thereby reducing the energy of the combustion gas as it passes through each of said plurality of baffles before the combustion gas exits said vent hole in said tube.

2. The assembly according to claim 1, wherein:

said tube has an inside surface which has a first threaded portion extending from a first end of said tube toward a second end of said tube;

said inside surface of said tube has a second threaded portion extending from said second end toward said first end;

said vent hole extends through an outer wall of said tube at a point located closer to said first end than said second end;

said inside surface of said tube has a first section which has a diameter being greater than a diameter of a second section of said inside surface;

said first section is associated with said first end;

said second section is associated with said second end; and a threshold between said first section and said second section is located closer to said second end of said tube than said first end.

3. A firearm suppressor assembly for reducing the intensity of the report of a firearm, said assembly comprising:

a modular suppressor comprising a tube and a pair of end caps each being attachable to opposing ends of said tube and a plurality of baffles each being positionable within said tube such that a first bullet hole in each of said pair of end caps is aligned with a second bullet hole in each of said plurality of baffles wherein said modular suppressor is configured to pass a bullet from a firearm through said first bullet hole in said end caps and said second bullet hole in each of said plurality of baffles when said modular suppressor is attached to a firearm, each of said plurality of baffles having a plurality of gas holes being in fluid communication with a vent hole in said tube wherein said plurality of baffles is configured to pass combustion gases produced from the combustion of gunpower through said gas holes and said vent hole thereby reducing the intensity of the report of the firearm;

wherein each of said pair of end caps has a head and a stem;

wherein an outside surface of said stem of each of said pair of end caps is threaded thereby facilitating said outside surface of said stem of each of said pair of end caps to threadably engage a respective one of said first threaded portion and said second threaded portion of said inside surface of said tube such that said head of each of said pair of end caps abuts a respective one of said first end and said second end of said tube;

wherein said head of each of said pair of end caps has an outer edge;

wherein said outer edge of each of head has a pair of flattened portions being positioned on opposing sides of said head from each other;

wherein said first bullet hole extends through a front surface of said head and a back surface of said stem; and wherein said first bullet hole is centrally located.

4. The assembly according to claim 3, wherein a bounding surface of said first bullet hole in a first one of said pair of end caps is threaded thereby facilitating said bounding surface of said first bullet hole in said first end cap to threadably engage a barrel of the firearm.

5. The assembly according to claim 1, wherein each of said plurality baffles comprises:

a disk having a first surface and a second surface, said second bullet hole extending through said first surface and second surface, said second bullet hole being centrally located on said disk; and a cone having a coupled end and a free end, said cone flaring outwardly between said coupled end and said free end, each of said coupled end and said free end being open, said coupled end being coupled to said second surface of said disk having coupled end surrounding said second bullet hole.

6. A firearm suppressor assembly for reducing the intensity of the report of a firearm, said assembly comprising:

a modular suppressor comprising a tube and a pair of end caps each being attachable to opposing ends of said tube and a plurality of baffles each being positionable within said tube such that a first bullet hole in each of said pair of end caps is aligned with a second bullet hole in each of said plurality of baffles wherein said modular suppressor is configured to pass a bullet from a firearm through said first bullet hole in said end caps and said second bullet hole in each of said plurality of baffles when said modular suppressor is attached to a firearm, each of said plurality of baffles having a plurality of gas holes being in fluid communication with a vent hole in said tube wherein said plurality of baffles is configured to pass combustion gases produced from the combustion of gunpower through said gas holes and said vent hole thereby reducing the intensity of the report of the firearm;

wherein each of said plurality baffles comprises a disk having a first surface and a second surface, said second bullet hole extending through said first surface and second surface, said second bullet hole being centrally located on said disk, and a cone having a coupled end and a free end, said cone flaring outwardly between said coupled end and said free end, each of said coupled end and said free end being open, said coupled end being coupled to said second surface of said disk having coupled end surrounding said second bullet hole;

wherein a respective pair of said gas holes extends through said first surface and said second surface of said disk;

wherein each of said respective gas holes is positioned between said second bullet hole and a perimeter edge of said disk;

wherein said pair of respective gas holes is aligned with each other; and wherein each of said pair of respective gas holes has a diameter that is less than a diameter of said second bullet hole.

7. The assembly according to claim 5, wherein:

respective ones of said plurality of gas holes extends through said cone at a point being centrally located between said coupled end and said free end; and said gas holes in said cone are positioned on opposite sides of said cone from each other.

8. The assembly according to claim 5, wherein said baffles are positioned in said tube such that said free end of said cone of each of said plurality of baffles abuts said first surface of said disk of an adjacent one of said plurality of baffles.

9. The assembly according to claim 2, wherein:

each of said plurality of baffles includes a disk which has a first surface; and said first surface of said disk of a rearmost one of said plurality of baffles in said tube abuts said threshold between said first portion of said inside surface of said tube and said second portion of said inside surface of said tube.

10. The assembly according to claim 2, wherein said plurality of baffles extends between said second portion of said inside surface of said tube and said first threaded portion of said inside surface of said tube when said plurality of baffles is positioned in said tube.

11. The assembly according to claim 1, wherein:

said tube has an inside surface which has a first threaded portion extending from a first end of said tube toward a second end of said tube, said inside surface of said tube having a second threaded portion extending from said second end toward said first end, said vent hole extending through an outer wall of said tube at a point located closer to said first end than said second end, said inside surface of said tube having a first section which has a diameter being greater than a diameter of a second section of said inside surface, said first section being associated with said first end, said second section being associated with said second end, a threshold between said first section and said second section being located closer to said second end of said tube than said first end;

each of said pair of end caps has a head and a stem, an outside surface of said stem of each of said pair of end caps being threaded thereby facilitating said outside surface of said stem of each of said pair of end caps to threadably engage a respective one of said first threaded portion and said second threaded portion of said inside surface of said tube such that said head of each of said pair of end caps abuts a respective one of said first end and said second end of said tube, said head of each of said pair of end caps having an outer edge, said outer edge of each of head having a pair of flattened portions being positioned on opposing sides of said head from each other, said first bullet hole extending through a front surface of said head and a back surface of said stem, said first bullet hole being centrally located, a bounding surface of said first bullet hole in a first one of said pair of end caps being threaded thereby facilitating said bounding surface of said first bullet hole in said first end cap to threadably engage a barrel of the firearm;

each of said plurality baffles comprises:

a disk having a first surface and a second surface, said second bullet hole extending through said first surface and second surface, said second bullet hole being centrally located on said disk, a respective pair of said gas holes extending through said first surface and said second surface, each of said respective gas holes being positioned between said second bullet hole and a perimeter edge of said disk, said pair of respective gas holes being aligned with each other, each of said pair of respective gas holes having a diameter being less than a diameter of said second bullet hole; and a cone having a coupled end and a free end, said cone flaring outwardly between said coupled end and said free end, each of said coupled end and said free end being open, said coupled end being coupled to said second surface of said disk having coupled end surrounding said second bullet hole, respective ones of said plurality of gas holes extending through said cone at point being centrally located between said coupled end and said free end, said gas holes in said cone being positioned on opposite sides of said cone from each other;

wherein said baffles are positioned in said tube such that said free end of said cone of each of said plurality of baffles abuts said first surface of said disk of an adjacent one of said plurality of baffles;

wherein said first surface of said disk of a rearmost one of said plurality of baffles in said tube abuts said threshold between said first portion of said inside surface of said tube and said second portion of said inside surface of said tube;

wherein said plurality of baffles extends between said second portion of said inside surface of said tube and said first threaded portion of said inside surface of said tube when said plurality of baffles is positioned in said tube.

* * * * *